US011859458B2

(12) United States Patent
Porter et al.

(10) Patent No.: US 11,859,458 B2
(45) Date of Patent: Jan. 2, 2024

(54) DISSOLVABLE PUMP DOWN DEVICES, DISSOLVABLE PUMP DOWN ASSEMBLIES, AND METHODS TO PROPEL A BOTTOMHOLE ASSEMBLY THROUGH A LATERAL SECTION OF A WELLBORE

(71) Applicant: Halliburton Energy Services, Inc., Houston, TX (US)

(72) Inventors: Jesse Cale Porter, Duncan, OK (US); Donald Ray Smith, Wilson, OK (US); Zachery Ryan Olson, San Antonio, TX (US); Aaron Jacob Miller, Addison, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/481,124

(22) Filed: Sep. 21, 2021

(65) Prior Publication Data

US 2022/0090458 A1 Mar. 24, 2022

Related U.S. Application Data

(60) Provisional application No. 63/081,727, filed on Sep. 22, 2020.

(51) Int. Cl.

| | |
|---|---|
| ***E21B 33/1295*** | (2006.01) |
| ***E21B 33/08*** | (2006.01) |
| ***E21B 23/04*** | (2006.01) |

(52) U.S. Cl.

CPC ..... *E21B 23/0413* (2020.05); *E21B 33/08* (2013.01); *E21B 33/1295* (2013.01); *E21B 2200/08* (2020.05)

(58) Field of Classification Search

CPC ..... E21B 22/08; E21B 33/1295; E21B 33/08; E21B 33/134

See application file for complete search history.

(56) References Cited

U.S. PATENT DOCUMENTS

| | | | |
|---|---|---|---|
| 9,500,061 | B2 | 11/2016 | Frazier et al. |
| 9,777,551 | B2 | 10/2017 | Davies et al. |

(Continued)

FOREIGN PATENT DOCUMENTS

| | | | |
|---|---|---|---|
| WO | 2018044440 | 3/2018 | |
| WO | 2019168502 | 9/2019 | |
| WO | WO-2020024057 A1 * | 2/2020 | ..... E21B 23/0413 |

*Primary Examiner* — Giovanna Wright

(74) *Attorney, Agent, or Firm* — Barnes & Thornburg LLP

(57) ABSTRACT

Dissolvable pump down devices, dissolvable pump down assemblies, and methods to propel a bottomhole assembly through a lateral section are presented. A dissolvable pump down device includes an engageable portion, and one or more expandable pieces that are initially in a first position before the dissolvable pump down device is deployed in a wellbore, and configured to expand from the first position to a second position in response to a force generated by fluid flow of fluid through the wellbore. A diameter of the expandable pieces while the expandable pieces are in the first position is less than the diameter of the one or more expandable pieces while the one or more expandable pieces are in the second position. The engageable portion and the one or more expandable pieces are configured to dissolve after the dissolvable pump down device is positioned at the desired wellbore location.

20 Claims, 4 Drawing Sheets

(56) References Cited

U.S. PATENT DOCUMENTS

| | | | | |
|---|---|---|---|---|
| 2014/0367122 | A1* | 12/2014 | Murphree | E21B 33/12<br>166/386 |
| 2020/0347694 | A1* | 11/2020 | Power | E21B 33/129 |
| 2021/0156211 | A1* | 5/2021 | Arabskyy | E21B 43/14 |
| 2021/0293120 | A1* | 9/2021 | George | E21B 33/1208 |

* cited by examiner

DISSOLVABLE PUMP DOWN DEVICES, DISSOLVABLE PUMP DOWN ASSEMBLIES, AND METHODS TO PROPEL A BOTTOMHOLE ASSEMBLY THROUGH A LATERAL SECTION OF A WELLBORE

BACKGROUND

The present disclosure relates generally to dissolvable pump down devices, dissolvable pump down assemblies, and methods to propel a bottomhole assembly through a lateral section of a wellbore.

Development of hydrocarbon reservoirs sometimes include drilling from a surface to a bedrock formation, developing a wellbore from the surface to near the formation, stimulating the formation by injecting fluid into the formation, and pumping the liquefied contents to the surface through the wellbore. This development process is sometimes time consuming, resource intensive, and costly.

BRIEF DESCRIPTION OF THE DRAWINGS

Illustrative embodiments of the present disclosure are described in detail below with reference to the attached drawing figures, which are incorporated by reference herein, and wherein.

Figure 1:
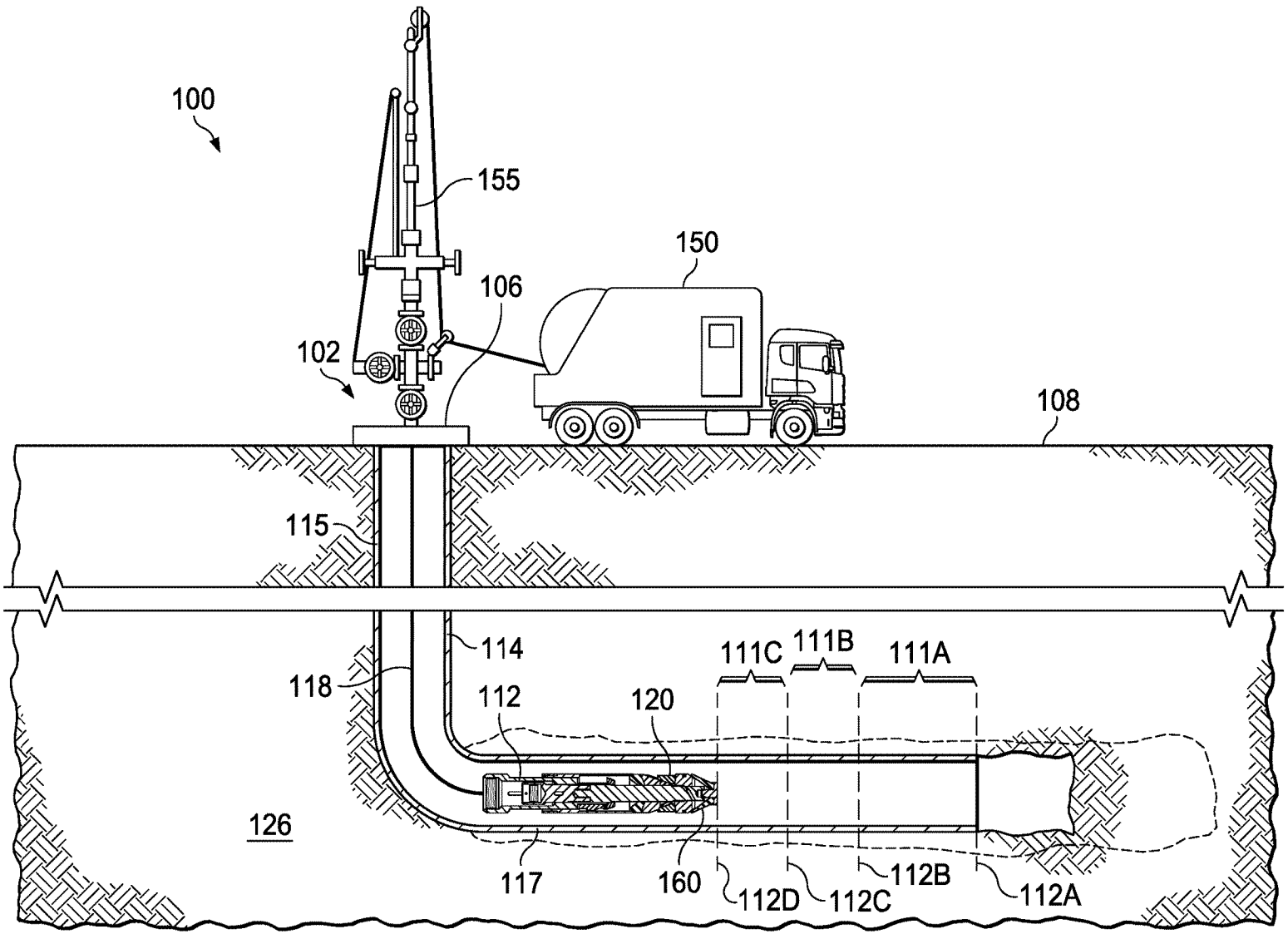
FIG. 1 is a schematic, side view of an environment in which a bottomhole assembly that is coupled to a dissolvable pump down assembly is lowered into a wellbore via a wireline.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to dissolvable pump down devices, dissolvable pump down assemblies, and methods to propel a bottomhole assembly through a lateral section of a wellbore. The dissolvable pump down device includes an engageable portion and one or more expandable pieces. As referred to herein, an engageable portion is a portion that is configured to engage to another component, device, or apparatus, such as a wellbore isolation device, a bottomhole assembly, or another component, device, or apparatus. Further, as referred to herein, expandable pieces include any accessory, component, device, or apparatus that is initially in a first position, and configured to expand from the first position to a second position, where the diameter of the one or more expandable pieces while the expandable pieces are in the second position is greater than the diameter of the one or more expandable pieces while the expandable pieces are in a first position. Examples of expandable pieces include flanges, rings, blades, wings, and other accessories, components, devices, or apparatuses that are shiftable or expandable from a first position to a second position to increase the diameter of the expandable pieces. In some embodiments, where the engageable portion of the dissolvable pump down device is coupled to a bottomhole assembly, the diameter of the one or more expandable pieces is approximately equal to the outer diameter of the bottomhole assembly when the bottomhole assembly and the dissolvable pump down device are initially lowered into a vertical section of a wellbore.

After the bottomhole assembly is lowered to a downhole location at or near the lateral section of the wellbore, fluid is injected into wellbore. A force applied by the fluid on the expandable pieces shifts or expands the expandable pieces from the first position to a second expanded position, such that the diameter of the expandable pieces increases while the expandable pieces are in the second position. In some embodiments, the expandable pieces expand radially outward toward the wall of the lateral section such that the diameter of the expandable pieces is greater than the outer diameter of the bottomhole assembly. The expansion of the expandable pieces increases the surface area of expandable pieces that come into contact with the fluid which, in turn, increases the force applied by the fluid onto the expandable pieces, and propels the dissolvable pump down device and the bottomhole assembly to a desired wellbore location, such as at or near a boundary of a zone of the wellbore. In some embodiments, the expandable pieces are configured to shift from the second position back to the first position if the force applied by the fluid is less than a threshold amount of force. In one or more of such embodiments, an operator controls the fluid flow of the fluid pumped downhole to propel the dissolvable pump down device to the desired location.

The dissolvable pump down device and a wellbore isolation device form a dissolvable pump down assembly that is coupled to the bottomhole assembly. As referred to herein, a wellbore isolation device refers to any device or apparatus configured to form a seal to isolate a section of the wellbore. Examples of wellbore isolation devices include, but are not limited to, frac plugs, darts, balls, packers and other devices or apparatuses configured to form a seal to isolate a section of the wellbore. The dissolvable pump down assembly is detachably coupled to bottomhole assembly such that the dissolvable pump down assembly detaches from, disengages, breaks off, or shears off bottomhole assembly after the dissolvable pump down assembly is positioned at the desired wellbore location, thereby allowing the bottomhole assembly to be retracted uphole, fitted with a second, third, or additional dissolvable pump down assemblies to be deployed to other locations of the lateral section of the wellbore, such as at or near other boundaries of the lateral section. In some embodiments, the process described herein is repeated to deploy a desired number of dissolvable pump down assemblies to different locations of the lateral section to form multiple seals and isolate multiple zones of the lateral section. In some embodiments, the dissolvable pump down assembly also includes a dissolvable mule shoe that is coupled to the dissolvable pump down device, and/or other components that facilitate the deployment of the dissolvable pump down assembly, facilitate the expandable pieces to shift from the first position to the second position and from the second position to the first position, and facilitate the dissolvable pump down assembly to detach, disengage, break off, shear off, or decouple from the bottomhole assembly.

The dissolvable pump down device is formed from a dissolvable material that dissolves after a period of time (such as a day, a week, a month, or another threshold of time) to reduce or eliminate the need to drill out the dissolvable pump down device. In some embodiments, the engageable portion and the expandable pieces are formed from different types of dissolvable materials and having different properties, and dissolve over different periods of time. In some embodiments, different components of the dissolvable pump down assembly are formed from different dissolvable materials. In some embodiments, some or all of the components of the dissolvable pump down assembly are formed from the same dissolvable material. Additional descriptions of the dissolvable pump down device, dissolvable pump down assembly, and methods to propel a bottomhole assembly through a lateral section of a wellbore are provided in the paragraphs below and are illustrated in at least FIGS. 1-5.

Turning now to the figures, FIG. 1 is a schematic, side view of an environment 100 in which a bottomhole assembly 112 that is coupled to a dissolvable pump down assembly is lowered into a wellbore 114 via a wireline 118. As shown in FIG. 1, wellbore 114 has a vertical section 115 that extends from a wellhead 106 at a surface 108 downwards to a formation 126, and a lateral section 117 that extends laterally or horizontally through formation 126. A wireline vehicle 150 is positioned near wellhead 106 to deploy wireline 118 through a wellhead 106 into wellbore 114. A lubricator is positioned above wellhead 106 to facilitate lowering wireline 118 down wellbore 114 and lifting wireline 118 up from wellhead 106 of a well 102.

In the embodiment of FIG. 1, bottomhole assembly 112 is coupled to a dissolvable pump down device 160 via an engageable portion of dissolvable pump down device 160. Dissolvable pump down device 160 also has one or more expandable pieces that are initially in a first position prior to and during initial deployment of bottomhole assembly 112. After bottomhole assembly 112 is lowered to a downhole location at or near lateral section 117, a fluid is injected into wellbore 114. In some embodiments, the fluid is injected from a fluid vehicle (not shown) that is positioned near wellhead 106. As the fluid flows through wellbore 114 and around bottomhole assembly 112, force applied by the fluid on the expandable pieces of dissolvable pump down device 160 shifts dissolvable pump down device 160 from the first position to a second expanded position, such that the diameter of the expandable pieces increases while the expandable pieces are in the second position. In some embodiments, the expandable pieces expand or bend radially outward toward the wall of lateral section 117 of wellbore 114. The expansion of the expandable pieces increases the surface area of expandable pieces that come into contact with the fluid which, in turn, increases the force applied by the fluid onto the expandable pieces, and propels dissolvable pump down device 160 to a desired wellbore location, such as a location at or near dash line 112A, which represents a first boundary of zone 111A. In some embodiments, the expandable pieces shift from the first position to the second position in response to a threshold amount of force or pressure applied by the fluid, and shift from the second position to the first position if less than the threshold amount of force or pressure is applied by the fluid. In that regard, an operator controls the amount of distance dissolvable pump down device 160 travels along lateral section 117 by controlling the fluid that is pumped down wellbore 114.

A wellbore isolation device 120 that is coupled to bottomhole assembly 112 and/or dissolvable pump down device 160 is then set off or actuated at or near dash line 112A to form a fluid seal at the first boundary of zone 111A. Examples of wellbore isolation devices include, but are not limited to, frac plugs, packers, darts, balls, and other devices or components configured to form a fluid seal around a section of a wellbore. In the embodiment of FIG. 1, wellbore isolation device 120 and dissolvable pump down device 160 together form a dissolvable pump down assembly that is detachably coupled to bottomhole assembly 112 such that the dissolvable pump down assembly detaches from, breaks off, or shears off bottomhole assembly 112 after the dissolvable pump down assembly is positioned at the desired wellbore location, thereby allowing bottomhole assembly 112 to be retracted uphole, fitted with a second dissolvable pump down assembly having a second dissolvable pump down device (not shown) and a second wellbore isolation device (not shown). The process described herein is then repeated to lower bottomhole assembly 112 down vertical section 115, flow fluid downhole to propel the second dissolvable pump down assembly to a second desired wellbore location at or near dash line 112B, which represents a second boundary of zone 111A. The second wellbore isolation device is set off and the second dissolvable pump down assembly detaches from, breaks off, or shears off bottomhole assembly 112. In the embodiment of FIG. 1, the foregoing process is repeated to propel additional dissolvable pump down assemblies (not shown) to desired downhole locations at or near dash lines 112C and 112D, and additional wellbore isolation devices of the dissolvable pump down assemblies are set off or actuated to form zones 111B and 111C.

In the embodiment of FIG. 1, each component of the dissolvable pump down assembly is formed from a dissolvable material. In some embodiments, dissolvable pump down device 160 and wellbore isolation device 120 are formed from different dissolvable materials. Additional descriptions and illustrations of dissolvable pump down device 160 and wellbore isolation device 120 are provided in the paragraphs below and are illustrated in at least FIGS. 2 and 3.

Although FIG. 1 illustrates four boundaries of three zones 111A-111C, in some embodiments, the operations described herein are performed a different number of iterations to propel a different number of dissolvable pump down assemblies (not shown) downhole to set or form a different number of seals or boundaries. Further, although FIG. 1 illustrates on lateral section 117, in some embodiments, multiple lateral sections are connected to vertical section 115 of wellbore 114. Further, although FIG. 1 illustrates wireline 118 that is coupled to bottomhole assembly 112, in some embodiments, another type of conveyance is coupled to bottomhole assembly 112 to deploy and retract bottomhole assembly 112. Further, although FIG. 1 illustrates a cased wellbore, the dissolvable pump down device 160 illustrated in FIG. 1, as well as other dissolvable pump down devices described herein, are deployable in open-hole wellbores, and cased wellbores and open-hole wellbores of offshore wells.

Figure 2:
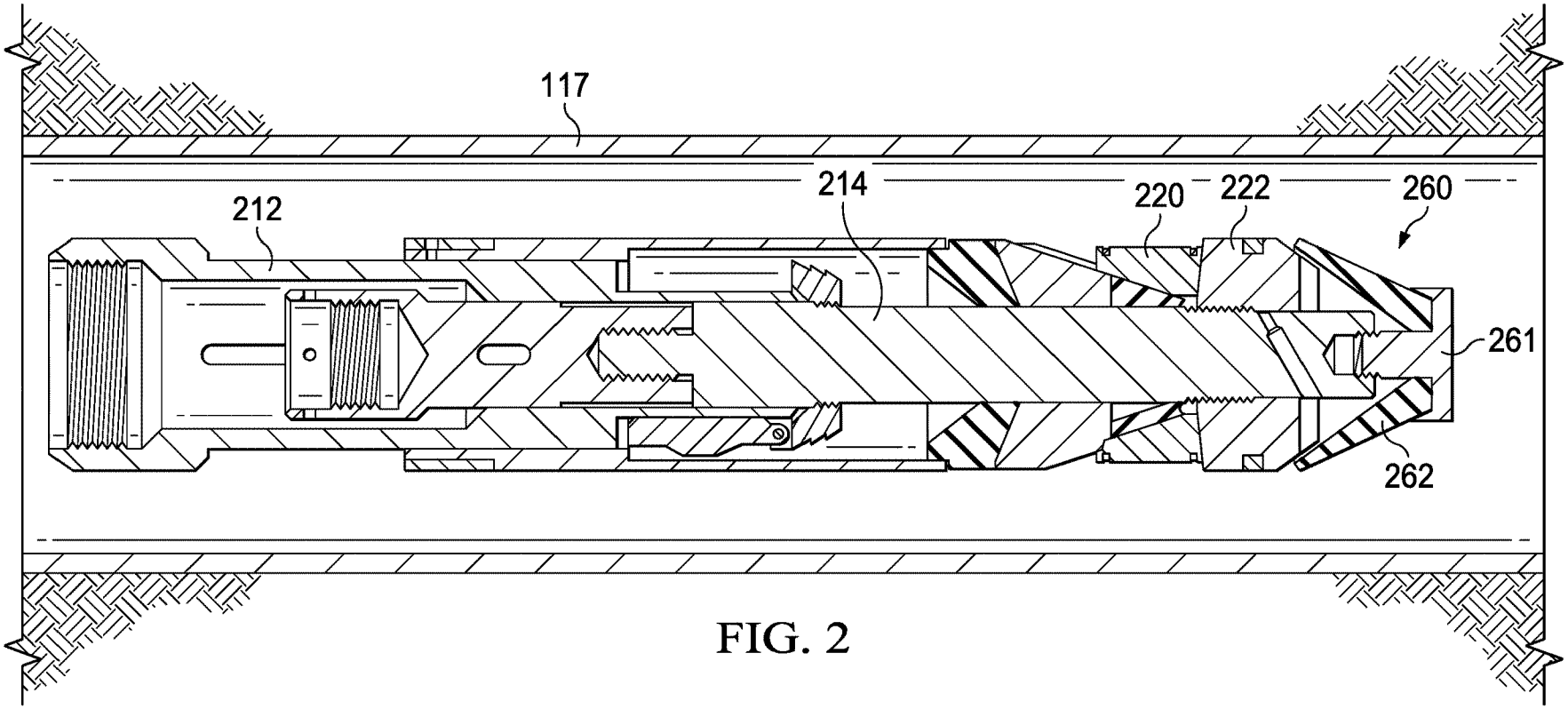
FIG. 2 is a cross-sectional view of a dissolvable pump down assembly similar to the dissolvable pump down assembly of FIG. 1, and coupled to a bottomhole assembly.

FIG. 2 is a cross-sectional view of a dissolvable pump down assembly similar to the dissolvable pump down assembly of FIG. 1, and coupled to a bottomhole assembly 212. In the embodiment of FIG. 2, the dissolvable pump down assembly includes a dissolvable pump down device 260, a mule shoe 222, and a wellbore isolation device 220, each of which is formed from a dissolvable material that dissolves after a period of time. Dissolvable pump down device 260 has an engageable portion 261 that is coupled to a mandrel 214 (such as a tension mandrel) of bottomhole assembly 212. In some embodiments, engageable portion 261 has a threaded interface that matches a corresponding threaded interface of mandrel 214 such that engageable portion 261 is screwed onto mandrel 214 to couple the dissolvable pump down assembly to bottomhole assembly 212. In one or more of such embodiments, the frangibility of the threaded interface, the number of threads of the threaded interface, and the frangibility of the engageable portion determine a setting force (such as the force applied to shear mandrel 214 and bottomhole assembly 212 away from the dissolvable pump down assembly). In some embodiments, flanges 262 are formed from a plastic, a soft metal, a synthetic rubber, or any combination thereof. In some embodiments, mule shoe 222 also has a threaded interface for receiving a threaded interface of mandrel 214. In one or more of such embodiments, a portion of mule shoe 222 is also configured to shear off mandrel 214 to detach bottomhole assembly 212 from the dissolvable pump down assembly.

Dissolvable pump down device 260 also includes flanges 262, which are in a first position as illustrated in FIG. 2. More particularly, the initial outer diameter of flanges 262 are equal to or approximately equal to the outer diameter of wellbore isolation device 220 and bottomhole assembly 212. Flanges 262 are configured to expand or shift outward, such as radially outward toward the wall of lateral section 117 in response to a threshold amount of force or pressure (such as force applied by a fluid pumped downhole into lateral section 117) applied to flanges 262, where the outer diameter of flanges 262 while flanges 262 are in the second position is greater than the outer diameter of flanges 262 while flanges 262 are in the first position as illustrated in FIG. 2. In some embodiments, flanges 262 form a circular or semi-circular canopy similar to a canopy of an umbrella, where flanges 262 are initially in a folded position (first position), similar to a folded position of an umbrella. Further, the outer diameter of flanges 262 expands radially outward (similar to the outer diameter of the canopy of the umbrella) as flanges 262 shift from the first folded position to a second deployed position. In some embodiments, the outer diameter of flanges 262 while in the second position is equal to or approximately equal to the diameter of lateral section 117. The expansion of flanges 262 increases the surface area of flanges 262 that come into contact with the fluid which, in turn, increases the force applied by the fluid onto flanges 262, and propels dissolvable pump down device 260, wellbore isolation device 220, and bottomhole assembly 212 to a desired wellbore location, such as a location at or near a boundary of a zone of lateral section 117. Wellbore isolation device 220 is then set or actuated to form a seal at or near the boundary of the zone.

The dissolvable pump down assembly is configured to detach from, disengage, break off, or shear away from bottomhole assembly 212 after dissolvable pump down device 260 is propelled to the desired location, thereby allowing retrieval of bottomhole assembly 212 for further operations, including operations described herein to propel additional pump down devices to other desired locations at or near other boundaries of lateral section 117 or other lateral sections to form additional seals. In some embodiments, a portion of engageable portion 261 that is coupled to mandrel 214 detaches from, disengages, breaks off, or shears away from the rest of engageable portion 261, thereby detaching bottomhole assembly 212 from the dissolvable pump down assembly.

In some embodiments, engageable portion 261 is formed from a hardened plastic or metal that is brittle and designed to crack and break apart under stress due to a setting force. In some embodiments, flanges 262 are formed from a flexible material such as a synthetic rubber. In some embodiments, flanges 262 are formed from a sturdier material, such as plastic, a soft metal, or any combination thereof. In some embodiments, engageable portion 261, flanges 262, mule shoe 222, and wellbore isolation device 220 are formed from different dissolvable materials that dissolve over different periods of time. In some embodiments, some of the components of the dissolvable pump down assembly are formed from materials that dissolve over similar or identical periods of time. Although FIG. 2 illustrates flanges 262, in some embodiments the dissolvable pump down assembly of FIG. 2 includes blades, wings, rings, or other accessories or components that are configured to radially expand from a first position to a second position in response to a threshold amount of force applied to the blades, wings, rings, or other accessories or components.

Figure 3:
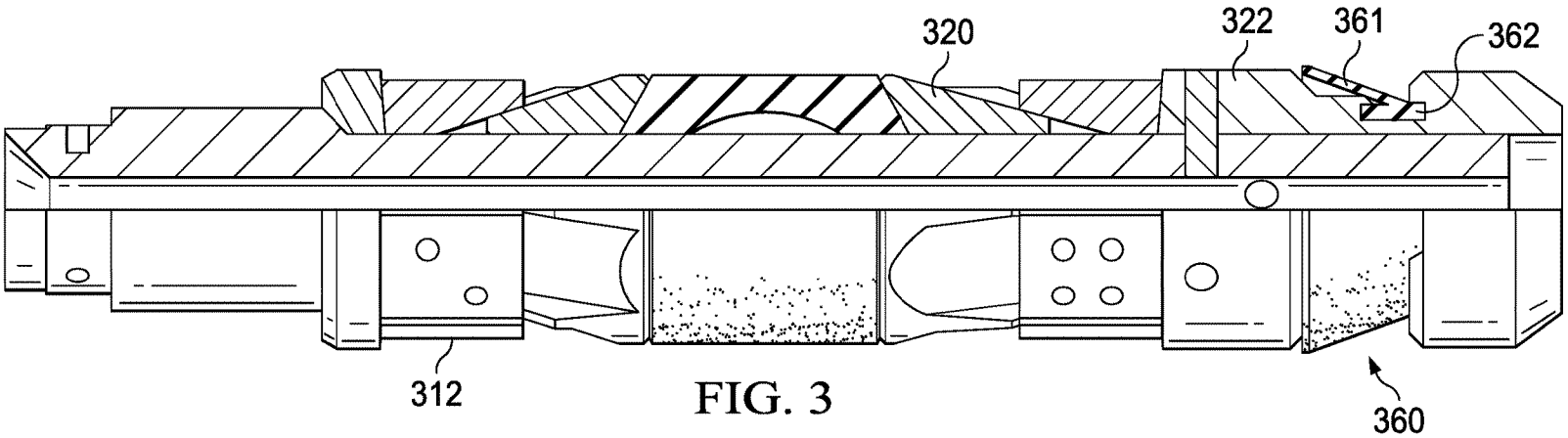
FIG. 3 is a cross-sectional view of a side and partially cross-sectional view of another dissolvable pump down assembly similar to the dissolvable pump down assembly of FIG. 1, and coupled to a bottomhole assembly.

FIG. 3 is a cross-sectional view of a side and partially cross-sectional view of another dissolvable pump down assembly similar to the dissolvable pump down assembly of FIG. 1, and coupled to a bottomhole assembly (not shown and positioned uphole or to the left of the dissolvable pump down assembly illustrated in FIG. 3). In the embodiment of FIG. 3, the dissolvable pump down assembly includes a dissolvable pump down device 360, a mule shoe 322, and a wellbore isolation device 320, each of which is formed from a dissolvable material that dissolves after a period of time. Dissolvable pump down device 360 has an engageable portion 362 that is coupled or fitted into a groove of mule shoe 322. In some embodiments, engageable portion 362 is fitted to (such as into a groove) or coupled to another component of the dissolvable pump down assembly. Dissolvable pump down device 360 also has an expandable piece 361 that is ring shaped and flexible at a connecting portion that connects expandable piece 361 to engageable portion 362 such that a threshold amount of pressure applied to expandable piece 361 shifts expandable piece 361 from the first position illustrated in FIG. 3, where the diameter of expandable piece 361 is approximately equal to the outer diameter of wellbore isolation device 320 and the bottomhole assembly, to a second position, where the outer diameter of the expandable piece at the second position is greater than the outer diameter of the expandable piece in the first position and as illustrated in FIG. 3. In some embodiments, expandable piece 361 forms a circular or semi-circular canopy similar to a canopy of an umbrella, where expandable piece 361 is initially in a folded position (first position), similar to a folded position of an umbrella. Further, the outer diameter of expandable piece 361 expands radially outward (similar to the outer diameter of the canopy of the umbrella) as expandable piece 361 bends or shifts from the first folded position to a second deployed position. The expansion of expandable piece 361 increases the surface area of expandable piece 361 that come into contact with the fluid which, in turn, increases the force applied by the fluid onto expandable piece 361, and propels dissolvable pump down device 360, wellbore isolation device 320, and the bottomhole assembly to a desired wellbore location, such as a location at or near a boundary of a zone of lateral section 117 of FIG. 1. Wellbore isolation device 320 is then set or actuated to form a seal at or near the boundary of the zone.

The dissolvable pump down assembly is configured to detach from, disengage, break off, or shear away from the bottomhole assembly after dissolvable pump down device 360 is propelled to the desired location, thereby allowing retrieval of the bottomhole assembly for further operations, including operations described herein to propel additional pump down devices to other desired locations at or near other boundaries of lateral section to form additional seals. In some embodiments, a threshold amount of force is applied to a shear pin (not shown) that is initially engaged to of the bottomhole assembly and a component of the dissolvable pump down assembly to shear the shear pin and detach or decouple the bottomhole assembly from the dissolvable pump down assembly.

Figure 4:
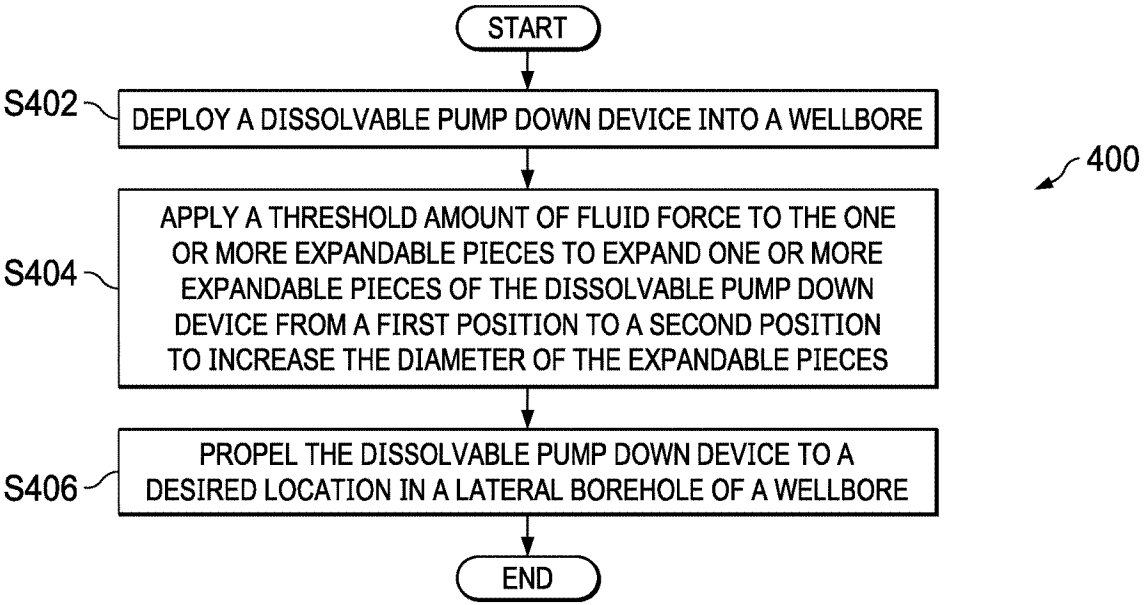
FIG. 4 is a flow chart of a process to propel a bottomhole assembly through a lateral section of a wellbore.

FIG. 4 is a flow chart of a process 400 to propel a bottomhole assembly through a lateral section of a wellbore. Although the operations in the process 400 are shown in a particular sequence, certain operations may be performed in different sequences or at the same time where feasible.

At block S402, a dissolvable pump down device that is coupled to a bottomhole assembly is deployed into a wellbore. In that regard, FIG. 1 illustrates deployable pump down device 160 that is coupled to bottomhole assembly 112 and deployed in wellbore 114. FIG. 2 illustrates a similar downhole device 260 and bottomhole assembly 212 deployed in lateral section 117 of wellbore 114 of FIG. 1. At block S404, a threshold amount of fluid force is applied to one or more expandable pieces of the dissolvable pump down device to expand the one or more pieces from a first position to a second position to increase the diameter of the expandable pieces. In the embodiment of FIG. 2, fluid pumped from a fluid source down wellbore 114 applies a threshold amount of force to flanges 262 of FIG. 2 to expand flanges 262 from the initial position illustrated in FIG. 2, where the outer diameter of flanges 262 is approximately equal to the outer diameter of wellbore isolation device 220 and bottomhole assemble 212, to a second position, where the outer diameter of flanges 262 at the second position is greater than the outer diameter of flanges 262 at the first position. Similarly, in the embodiment of FIG. 3, fluid pumped from a fluid source down wellbore 114 applies a threshold amount of force to the ring shaped expandable piece 361 of FIG. 3 to expand expandable piece 361 from the initial position illustrated in FIG. 4, where the outer diameter of expandable piece 361 is approximately equal to the outer diameter of wellbore isolation device 320 and bottomhole assemble 312, to a second position, where the outer diameter of expandable piece 361 at the second position is greater than the outer diameter of expandable piece 361 at the first position. Moreover, the expansion of the expandable pieces increases the surface area of expandable pieces that come into contact with the fluid which, in turn, increases the force applied by the fluid onto the expandable pieces.

At block S406, the dissolvable pump down device is propelled to a desired location in a lateral section of a wellbore. In some embodiments, the threshold amount of force applied to the expandable pieces to propel the dissolvable pump down device is similar or identical to the threshold amount of force applied to the expandable pieces to shift or expand the expandable pieces from the first position to the second position. In some embodiments, the threshold amount of force applied to the expandable pieces to propel the dissolvable pump down device is greater than the threshold amount of force applied to the expandable pieces to shift or expand the expandable pieces from the first position to the second position. In some embodiments, the amount of force applied to the one or more expandable pieces varies (while being above the threshold amount) to control or vary the rate at which the dissolvable pump down device traverses the lateral section. In some embodiments, the expandable pieces shift from the second position to the first position if the amount of force applied to the expandable pieces is less than a threshold amount of force. In some embodiments, after the dissolvable pump down device is propelled to a desired location, such as at or near a wellbore boundary illustrated by line 112A of FIG. 1, a wellbore isolation device (such as a frac plug) that is coupled to the dissolvable pump down device is actuated or set to form a fluid seal at or near the wellbore boundary.

Figure 5:
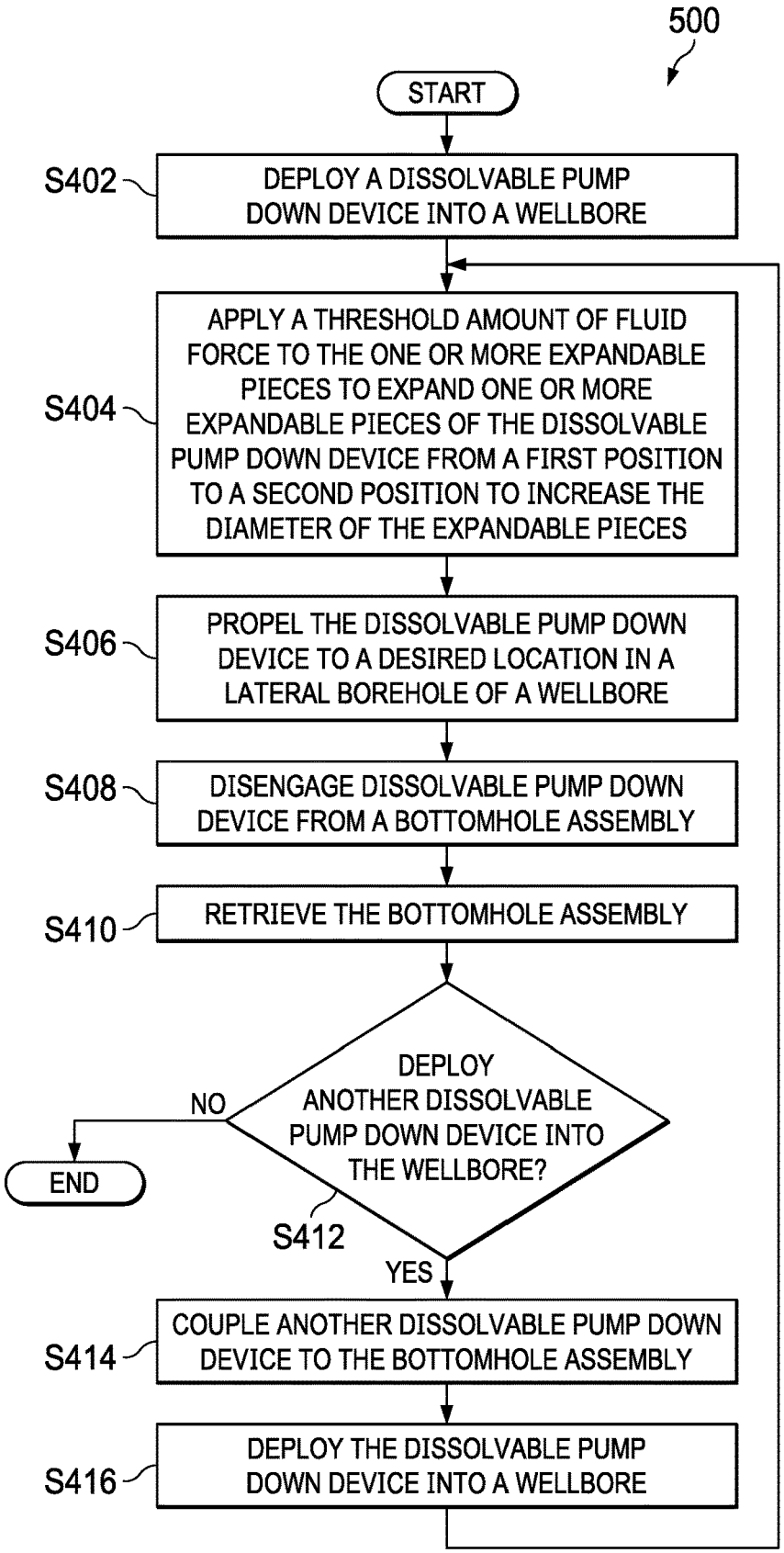
FIG. 5 is a flow chart of a process to propel the bottomhole assembly of FIG. 4 to multiple locations of the lateral section of the wellbore of FIG. 4.

FIG. 5 is a flow chart of a process 500 to propel the bottomhole assembly of FIG. 4 to multiple locations of the lateral section of the wellbore. Although the operations in the process 500 are shown in a particular sequence, certain operations may be performed in different sequences or at the same time where feasible.

Operations performed at blocks S402, S404, and S406 are described in the paragraphs above. At block S408, the dissolvable pump down device is disengaged, decoupled, or sheared from the bottomhole assembly. In the embodiment of FIG. 2, a portion of engageable portion 261 that is coupled to mandrel 214 of bottomhole assembly 212 shears off or breaks off from the rest of engageable portion 261 which, in turn, disengages bottomhole assembly 212 from the dissolvable pump down assembly. At block S410, the bottomhole assembly is retrieved, such as retrieved to surface 108 of FIG. 1. At block S412, a determination on whether to deploy another dissolvable pump down device into the wellbore, such as wellbore 114 of FIG. 1 is made. The process ends if no additional dissolvable pump down device is deployed into the wellbore. Alternatively, the process proceeds to block S414 if a determination to deploy another dissolvable pump down device is made. At block S414 a second dissolvable pump down device is coupled to the bottomhole assembly, such as bottomhole assembly 112 of FIG. 1.

At block S416, the second dissolvable pump down device and the bottomhole assembly are deployed into the wellbore, such as wellbore 114 of FIG. 1. The process then proceeds to block S404, and operations performed at blocks S404, S406, S408, and S410 are performed to propel the second dissolvable pump down device to a desired wellbore location, such as a second boundary defined by dash lines 112B of FIG. 1, disengage the bottomhole assembly from the second dissolvable pump down device, and retrieve the bottomhole assembly for deployment of additional dissolvable pump down devices or other operations.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure.

Clause 1, a dissolvable pump down device comprising: an engageable portion; and one or more expandable pieces, each of the one or more expandable pieces initially being in a first position before the dissolvable pump down device is deployed in a wellbore, and each of the one or more expandable pieces configured to expand from the first position to a second position in response to a force generated by fluid flow of a fluid through the wellbore, wherein a diameter of the one or more expandable pieces while the one or more expandable pieces are in the first position is less than the diameter of the one or more expandable pieces while the one or more expandable pieces are in the second position, and wherein the engageable portion and the one or more expandable pieces are configured to dissolve after the dissolvable pump down device is positioned at the desired wellbore location.

Clause 2, the dissolvable pump down device of clause 1, wherein the one or more expandable pieces are configured to propel the dissolvable pump down device to the desired wellbore location while the one or more expandable pieces are in the second position.

Clause 3, the dissolvable pump down device of clauses 1 or 2, wherein the one or more expandable pieces are configured to shift from the second position towards the first position after the dissolvable pump down device is positioned at the desired downhole location.

Clause 4, the dissolvable pump down device of clause 3, wherein the one or more expandable pieces are configured to shift from the second position towards the first position if the force generated by the fluid flow of the fluid onto the one or more expandable pieces is less than a threshold amount of force.

Clause 5, the dissolvable pump down device of any of clauses 1-4, wherein after the one or more expandable pieces expand to the second position, the diameter of the one or more expandable pieces is greater than a diameter of a bottomhole assembly that is coupled to the dissolvable pump down device.

Clause 6, the dissolvable pump down device of any of clauses 1-5, wherein the one or more expandable pieces are flanges, and wherein each of the one or more flanges is configured to expand from the first position to the second position.

Clause 7, the dissolvable pump down device of any of clauses 1-5, wherein the one or more expandable pieces are rings, and wherein each of the one or more rings is configured to expand from the first position to the second position.

Clause 8, the dissolvable pump down device of any of clauses 1-7, wherein the engageable portion is configured to engage to a mandrel of a bottomhole assembly, and wherein the engageable portion is configured to shear off the mandrel after the dissolvable pump down device is positioned at the desired downhole location.

Clause 9, the dissolvable pump down device of any of clauses 1-8, wherein the engageable portion is coupled to a wellbore isolation device that is configured to form a seal after the dissolvable pump down device is positioned at the desired downhole location.

Clause 10, the dissolvable pump down device of clause 9, wherein the dissolvable pump down device is coupled to a mule shoe, and wherein the wellbore isolation device and the mule shoe are formed from dissolvable materials.

Clause 11, the dissolvable pump down device of any of clauses 1-10, wherein the one or more expandable pieces are formed from a first dissolvable material that dissolves at a first rate, and wherein the engageable portion is formed from a second dissolvable material that dissolves at a second rate.

Clause 12, a dissolvable pump down assembly comprising: a wellbore isolation device configured to set at a desired wellbore location to form a fluid seal; and a dissolvable pump down device comprising: an engageable portion; and one or more expandable pieces, each of the one or more expandable pieces initially being in a first position before the dissolvable pump down device is deployed in a wellbore, and each of the one or more expandable pieces configured to expand from the first position to a second position in response to a force generated by fluid flow of a fluid through the wellbore, wherein a diameter of the one or more expandable pieces while the one or more expandable pieces are in the first position is less than the diameter of the one or more expandable pieces while the one or more expandable pieces are in the second position, and wherein the engageable portion and the one or more expandable pieces are configured to dissolve after the dissolvable pump down device is positioned at the desired wellbore location.

Clause 13, the dissolvable pump down assembly of clause 12, wherein the one or more expandable pieces are configured to propel the dissolvable pump down device to the desired wellbore location while the one or more expandable pieces are in the second position.

Clause 14, the dissolvable pump down assembly of clause 13, wherein the one or more expandable pieces are configured to shift from the second position towards the first position after the dissolvable pump down device is positioned at the desired downhole location.

Clause 15, the dissolvable pump down assembly of clause 14, wherein the one or more expandable pieces are configured to shift from the second position towards the first position if the force generated by the fluid flow of the fluid onto the one or more expandable pieces is less than a threshold amount of force.

Clause 16, the dissolvable pump down assembly of any of clauses 12-15, further comprising a mule shoe, wherein the wellbore isolation device and the mule shoe are formed from dissolvable materials.

Clause 17, the dissolvable pump down assembly of any of clauses 12-16, wherein the wellbore isolation device is one of a frac plug, a dart, or a ball.

Clause 18, a method to deploy a bottomhole assembly through a lateral section of a wellbore, comprising: deploying a dissolvable pump down device that is coupled to a bottomhole assembly into a wellbore, the dissolvable pump down device comprising: an engageable portion; and one or more expandable pieces, each of the one or more expandable pieces initially being in a first position before the dissolvable pump down device is deployed in a wellbore; applying a threshold amount of fluid force to the one or more expandable pieces to expand the one or more expandable pieces from the first position to a second position, wherein a diameter of the one or more expandable pieces while the one or more expandable pieces are in the first position is less than the diameter of the one or more expandable pieces while the one or more expandable pieces are in the second position; and propelling the dissolvable pump down device to a desired location in a lateral section of the wellbore.

Clause 19, the method of clause 18, further comprising after the dissolvable pump down device is propelled to the desired location, actuating a wellbore isolation device that is coupled to the dissolvable pump down device to form a fluid seal.

Clause 20, the method of clauses 18 or 19, wherein the engageable portion is initially coupled to the bottomhole assembly, the method further comprising after the dissolvable pump down device is propelled to the desired location: disengaging the bottomhole assembly from the dissolvable pump down device; and dissolving the dissolvable pump down device.

As used herein, the singular forms "a," "an," and "the" are intended to include the plural forms as well, unless the context clearly indicates otherwise. It will be further understood that the terms "comprise" and/or "comprising," when used in this specification and/or in the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A dissolvable pump down device comprising:

an engageable portion comprising a metal; and one or more expandable pieces, each of the one or more expandable pieces initially being in a first position before the dissolvable pump down device is deployed in a wellbore, and each of the one or more expandable pieces configured to expand from the first position to a second position in response to a force generated by fluid flow of a fluid through the wellbore, wherein the one or more expandable pieces are rubber flanges, and wherein each of the one or more flanges is configured to expand from the first position to the second position, wherein a diameter of the one or more expandable pieces while the one or more expandable pieces are in the first position is less than the diameter of the one or more expandable pieces while the one or more expandable pieces are in the second position, and wherein the engageable portion and the one or more expandable pieces are configured to dissolve after the dissolvable pump down device is positioned at the desired wellbore location; wherein the engageable portion is coupled to a wellbore isolation device that is configured to form a seal after the dissolvable pump down device is positioned at the desired downhole location; wherein the dissolvable pump down device is coupled to a mule shoe, and wherein the wellbore isolation device and the mule shoe are formed from dissolvable materials.

2. The dissolvable pump down device of claim 1, wherein the one or more expandable pieces are configured to propel the dissolvable pump down device to the desired wellbore location while the one or more expandable pieces are in the second position.

3. The dissolvable pump down device of claim 2, wherein the one or more expandable pieces are configured to shift from the second position towards the first position after the dissolvable pump down device is positioned at the desired downhole location.

4. The dissolvable pump down device of claim 3, wherein the one or more expandable pieces are configured to shift from the second position towards the first position if the force generated by the fluid flow of the fluid onto the one or more expandable pieces is less than a threshold amount of force.

5. The dissolvable pump down device of claim 1, wherein after the one or more expandable pieces expand to the second position, the diameter of the one or more expandable pieces is greater than a diameter of a bottomhole assembly that is coupled to the dissolvable pump down device.

6. The dissolvable pump down device of claim 1, wherein the engageable portion is configured to engage to a mandrel of a bottomhole assembly, and wherein the engageable portion is configured to shear off the mandrel after the dissolvable pump down device is positioned at the desired downhole location.

7. The dissolvable pump down device of claim 1, wherein the one or more expandable pieces are formed from a first dissolvable material that dissolves at a first rate, and wherein the engageable portion is formed from a second dissolvable material that dissolves at a second rate.

8. The dissolvable pump down device of claim 1, wherein the wellbore isolation device is one of a frac plug, a dart, or a ball.

9. A dissolvable pump down assembly comprising:

a wellbore isolation device configured to set at a desired wellbore location to form a fluid seal;

and a dissolvable pump down device comprising:

an engageable portion comprising a metal; and one or more expandable pieces, each of the one or more expandable pieces initially being in a first position before the dissolvable pump down device is deployed in a wellbore, and each of the one or more expandable pieces configured to expand from the first position to a second position in response to a force generated by fluid flow of a fluid through the wellbore, wherein the one or more expandable pieces are rubber flanges, and wherein each of the one or more flanges is configured to expand from the first position to the second position, a mule shoe, wherein the wellbore isolation device and the mule shoe are formed from dissolvable materials, wherein a diameter of the one or more expandable pieces while the one or more expandable pieces are in the first position is less than the diameter of the one or more expandable pieces while the one or more expandable pieces are in the second position, and wherein the engageable portion and the one or more expandable pieces are configured to dissolve after the dissolvable pump down device is positioned at the desired wellbore location.

10. The dissolvable pump down assembly of claim 9, wherein the one or more expandable pieces are configured to propel the dissolvable pump down device to the desired wellbore location while the one or more expandable pieces are in the second position.

11. The dissolvable pump down assembly of claim 10, wherein the one or more expandable pieces are configured to shift from the second position towards the first position after the dissolvable pump down device is positioned at the desired downhole location.

12. The dissolvable pump down assembly of claim 11, wherein the one or more expandable pieces are configured to shift from the second position towards the first position if the force generated by the fluid flow of the fluid onto the one or more expandable pieces is less than a threshold amount of force.

13. The dissolvable pump down assembly of claim 9, wherein the wellbore isolation device is one of a frac plug, a dart, or a ball.

14. The dissolvable pump down assembly of claim 9, wherein the engageable portion is configured to engage to a mandrel of a bottomhole assembly, and wherein the engageable portion is configured to shear off the mandrel after the dissolvable pump down device is positioned at the desired downhole location.

15. The dissolvable pump down assembly of claim 9, wherein the one or more expandable pieces are formed from a first dissolvable material that dissolves at a first rate, and wherein the engageable portion is formed from a second dissolvable material that dissolves at a second rate.

16. A method to deploy a bottomhole assembly through a lateral section of a wellbore, comprising:

deploying a dissolvable pump down device that is coupled to a bottomhole assembly into a wellbore, the dissolvable pump down device comprising:

an engageable portion comprising a metal; and one or more expandable pieces, each of the one or more expandable pieces initially being in a first position before the dissolvable pump down device is deployed in a wellbore, wherein the one or more expandable pieces are rubber flanges, and wherein each of the one or more flanges is configured to expand from the first position to the second position;

applying a threshold amount of fluid force to the one or more expandable pieces to expand the one or more expandable pieces from the first position to a second position, wherein a diameter of the one or more expandable pieces while the one or more expandable pieces are in the first position is less than the diameter of the one or more expandable pieces while the one or more expandable pieces are in the second position; and propelling the dissolvable pump down device to a desired location in a lateral section of the wellbore; wherein the engageable portion is coupled to a wellbore isolation device that is configured to form a seal after the dissolvable pump down device is positioned at the desired downhole location; wherein the dissolvable pump down device is coupled to a mule shoe, and wherein the wellbore isolation device and the mule shoe are formed from dissolvable materials.

17. The method of claim 16, further comprising after the dissolvable pump down device is propelled to the desired location, actuating a wellbore isolation device that is coupled to the dissolvable pump down device to form a fluid seal.

18. The method of claim 16, wherein the engageable portion is initially coupled to the bottomhole assembly, the method further comprising after the dissolvable pump down device is propelled to the desired location:

disengaging the bottomhole assembly from the dissolvable pump down device; and dissolving the dissolvable pump down device.

19. The method of claim 16, wherein the engageable portion is configured to engage to a mandrel of the bottomhole assembly, and wherein the engageable portion is configured to shear off the mandrel after the dissolvable pump down device is positioned at the desired downhole location.

20. The method of claim 16, wherein the wellbore isolation device is one of a frac plug, a dart, or a ball.

* * * * *